US009062933B1

(12) United States Patent
Allen et al.

(10) Patent No.: US 9,062,933 B1
(45) Date of Patent: Jun. 23, 2015

(54) TACTICAL ILLUMINATOR SYSTEM

(71) Applicants: John M. Allen, Wake Forest, NC (US); Stephen Kelly, Fuquay Varina, NC (US); Kevin Burge, Raleigh, NC (US)

(72) Inventors: John M. Allen, Wake Forest, NC (US); Stephen Kelly, Fuquay Varina, NC (US); Kevin Burge, Raleigh, NC (US)

( * ) Notice: Subject to any disclaimer, the term of this patent is extended or adjusted under 35 U.S.C. 154(b) by 250 days.

(21) Appl. No.: 13/735,585

(22) Filed: Jan. 7, 2013

(51) Int. Cl.

| | |
|---|---|
| ***F41G 1/34*** | (2006.01) |
| ***F41G 1/35*** | (2006.01) |
| ***F21L 4/02*** | (2006.01) |
| ***F21V 21/34*** | (2006.01) |

(52) U.S. Cl.
CPC ... *F41G 1/35* (2013.01); *F21L 4/02* (2013.01); *F21V 21/34* (2013.01)

(58) Field of Classification Search
CPC ..... F41G 1/35; F41G 1/36; F21L 4/00; F21L 4/027; F21V 21/08; F21Y 2101/02
USPC ..... 42/146, 114; 362/110, 111, 157, 208; 224/243, 912, 338; 200/60
See application file for complete search history.

(56) References Cited

U.S. PATENT DOCUMENTS

| | | | |
|---|---|---|---|
| 4,627,183 | A | 12/1986 | Stuckman |
| 6,345,464 | B1 | 2/2002 | Kim et al. |
| 6,363,648 | B1 | 4/2002 | Kranich et al. |
| 6,473,980 | B2 | 11/2002 | Ripingill, Jr. et al. |
| 6,591,536 | B2 | 7/2003 | Houde-Walter et al. |
| 6,604,315 | B1 | 8/2003 | Smith et al. |
| 6,622,416 | B2 | 9/2003 | Kim |
| 6,675,521 | B1 | 1/2004 | Kim |
| 6,785,997 | B2 | 9/2004 | Oz |
| 6,892,488 | B1 | 5/2005 | Serravalle |
| 7,264,369 | B1 | 9/2007 | Howe |
| 7,441,364 | B2 | 10/2008 | Rogers et al. |
| 7,685,761 | B2 | 3/2010 | Wu |
| 7,726,061 | B1 | 6/2010 | Thummel |
| 7,731,380 | B2 | 6/2010 | Wu |
| 7,735,255 | B1 | 6/2010 | Kincaid et al. |
| 7,753,549 | B2 | 7/2010 | Solinsky et al. |
| 7,866,083 | B2 | 1/2011 | Teetzel |
| 7,954,971 | B1 | 6/2011 | Kincaid et al. |
| 8,091,267 | B2 | 1/2012 | Moore et al. |
| 8,109,032 | B2 | 2/2012 | Faifer |
| 8,117,782 | B2 | 2/2012 | Gross et al. |
| 8,132,355 | B1 | 3/2012 | Kincaid et al. |
| 8,141,290 | B2 | 3/2012 | LaFrance et al. |
| 2007/0009860 | A1 | 1/2007 | Young |
| 2007/0039226 | A1 * | 2/2007 | Stokes ..... 42/146 |
| 2007/0227056 | A1 | 10/2007 | Howe et al. |
| 2008/0039962 | A1 | 2/2008 | McRae |

(Continued)

*Primary Examiner* — Stephen F Husar
*Assistant Examiner* — Danielle Allen
(74) *Attorney, Agent, or Firm* — Albert Bordas, P.A.

(57) ABSTRACT

A tactical illuminating system for weapons. The tactical illuminating system for weapons has a grip body with a joystick button. The grip body has at least first and second illumination sources and at least one laser emitter. The grip body mounts onto a rail member of a quail rail hand guard. The tactical illuminating system also has an electrical system and at least first and second side illuminator housings with third and fourth illumination sources respectively. The at least first and second side illuminator housings mount onto the quail rail hand guard. The at least first and second, and third and fourth, illumination sources are positioned on both sides of a weapon, and are independently controlled by the joystick button to provide light sources on strong and/or advantageous sides of the weapon when cornering without having to change grip, sight picture, an angle of said weapon, or stance.

20 Claims, 4 Drawing Sheets

(56) References Cited

U.S. PATENT DOCUMENTS

| | | | |
|---|---|---|---|
| 2008/0060248 | A1 | 3/2008 | Pine |
| 2009/0178325 | A1 | 7/2009 | Veilleux |
| 2010/0154280 | A1 | 6/2010 | LaFrance et al. |
| 2011/0167707 | A1 | 7/2011 | Gross et al. |
| 2011/0232151 | A1 | 9/2011 | Zukowski |
| 2011/0252681 | A1 | 10/2011 | Houde-Walter et al. |
| 2012/0005938 | A1 | 1/2012 | Sloan |
| 2012/0055061 | A1 | 3/2012 | Hartley et al. |

* cited by examiner

TACTICAL ILLUMINATOR SYSTEM

BACKGROUND OF THE INVENTION

1. Field of the Invention

The present invention relates to weapons accessories, and more particularly, to tactical illuminating systems for weapons.

2. Description of the Related Art

Applicant believes that one of the closest references corresponds to U.S. Pat. No. 6,345,464 B1 issued to Kim, et al. on Feb. 12, 2002 for firearms with target illuminators, electric switching devices and battery power sources. However, it differs from the present invention because Kim, et al. teaches an apparatus for firing projectiles at targets and for illuminating such targets including a projectile-firing elongate weapon having a fore-end structure and a target illuminator on that fore-end structure in a first quadrant between a vertical plane and a horizontal plane longitudinally through such elongate weapon in a firing position of that weapon. Additionally or alternatively, a target illuminator may include a housing in one piece with part of the fore-end structure. An electric lamp assembly for target illuminators, flashlights or other light sources has a support structure, a bezel structure on that support structure, and a shock-absorbed reflector structure inside that bezel structure. Such shock-absorbed reflector structure includes a reflector having a focal point, a first shock absorber between that reflector and the support structure and a second shock absorber between the bezel structure and that reflector. An electric light source has a luminous portion maintained on the focal point in the reflector by corresponding transverse and longitudinal luminous portion positioners at the light source and the shock-absorbed reflector. An electric battery is composed of individually jacketed battery elements and a battery elements carrier of one or more compartments into which such battery elements are individually insertable side by side with all like terminals of such battery elements being on the same side in the or each compartment. A rotary switch has a self-contained electric ON/OFF switch having a projecting actuator, an angularly moveable actuator knob separate from that self-contained electric ON/OFF switch and projecting actuator, and a force-transmitting coupling from such angularly moveable actuator knob to the actuator of the electric ON/OFF switch. A rocker switch has a bistable rocker device including a pair of toggles and a pivoted rocker arm between that pair of toggles alterable between a stable OFF position and an alternative stable ON position.

Applicant believes that another reference corresponds to U.S. Pat. No. 8,117,782 B1 issued to Gross, et al. on Feb. 21, 2012 for a tactical illuminator. However, it differs from the present invention because Gross, et al. teaches a tactical illuminator having an integrated illuminator system including a horizontally-oriented foregrip, a power source, a rotary switch, a toggle switch, a depressible switch, an attachment mechanism, navigation lights, an aiming laser, and a main illuminator.

Applicant believes that another reference corresponds to U.S. Pat. No. 8,109,032 B2 issued to Faifer on Feb. 7, 2012 for an accessory holder with linear actuator. However, it differs from the present invention because Faifer teaches an accessory holder including a housing for holding an accessory and a switching mechanism operable independently from at least two locations on the holder for actuating an accessory in the housing. In particular, the accessory holder can be mounted on a T-grip.

Applicant believes that another reference corresponds to U.S. Pat. No. 8,091,267 B2 issued to Moore, et al. on Jan. 10, 2012 for a gun-mounted sighting device. However, it differs from the present invention because Moore, et al. teaches a sighting device mountable to a gun. The device includes a light source, a power source connectable to the light source and a mount attachable to the gun so that the laser is juxtaposed either the top surface of the gun or a side surface of the gun. In one embodiment, the sighting device includes a bottom rail mountable in a slot on the gun, wherein the slot is preferably positioned on the top surface of the gun. The sighting device may also include a mechanical sight that functions as the rear mechanical sight on the gun and/or a secondary light source.

Applicant believes that another reference corresponds to U.S. Pat. No. 7,954,971 B1 issued to Kincaid, et al. on Jun. 7, 2011 for an offset mountable light accessory. However, it differs from the present invention because Kincaid, et al. teaches an offset mountable light, including a light body, wherein the light body includes a battery compartment positioned within a cavity formed by the light body; a light hood housing a light source; at least three electrical contacts formed in the light body, wherein the at least three electrical contacts comprise at least one inner contact and at least two outer contacts; a controller that is capable of controlling the light source to illuminate in a predetermined manner; a light switch bar pivotably coupled to the light body; and an accessory mounting clamp coupled to the offset mountable light, wherein the accessory mounting clamp mounts the mountable light to an accessory rail, such that the mountable light is mounted offset from the accessory rail.

Applicant believes that another reference corresponds to U.S. Pat. No. 7,866,083 B2 issued to Teetzel on Jan. 11, 2011 for a modular flashlight apparatus for firearm. However, it differs from the present invention because Teetzel teaches a flashlight apparatus including a base module having a mount adaptor mountable on a firearm, a reflector module removably attachable to the base module, a power source module removably attached to the base module, and a light source module removably attachable to the base module, the light source module including an illumination light source and a laser light source. In a further aspect, an identification friend or foe system is provided.

Applicant believes that another reference corresponds to U.S. Pat. No. 7,731,380 B2 issued to Wu on Jun. 8, 2010 for a weapon mount tactical light trigger. However, it differs from the present invention because Wu teaches a weapon mount tactical light trigger that includes a mount for a Picatinny rail to clamp to a shotgun or rifle, a light mount to clamp a tactical light, and a principle mount to joint both mounts with a trigger base fixed at the back. Components of the trigger base include a trigger to switch on/off the tactical light, a circular shaft to allocate the trigger on the trigger base and a fixing bolt to keep the trigger and switch of the light to stay connected under normal conditions. When a user presses the trigger with a finger, the trigger pivots on the circular shaft and exerts pressure to the switch of the tactical light. The structure design of the trigger base is according to the principle of leverage; via pressing the trigger, it exerts pressure to the switch to turn on/off the light; as the mechanism design of this creation avoids possible shortfall of wire conduction and enhance the performance stability of the tactical light.

Applicant believes that another reference corresponds to U.S. Pat. No. 7,685,761 B2 issued to Wu on Mar. 30, 2010 for a trigger activating tactical light grip. However, it differs from the present invention because Wu teaches a trigger activating tactical light grip that includes a Picatinny rail mount to assemble the grip to the firearm, a tactical light mount to mount the tactical light and a grip to provide a place for holding the gun. In the grip, there is a trigger to initiate movement for a connecting rod, and the connecting rod is to deliver the movement of the trigger, a tunnel for the connecting rod to slide along, a circular shaft to assemble the trigger, and a fixing pin to keep the connecting rod to be contacted with the tactical light switch. When a user provides pressure with a finger on the trigger, it pivots on the circular shaft and leads the connecting rod to slide along the tunnel. As a result, the connecting rod exerts pressure to the switch of the tactical light and then the aim of activating the tactical light is accomplished.

Applicant believes that another reference corresponds to U.S. Pat. No. 7,441,364 B2 issued to Rogers, et al. on Oct. 28, 2008 for an adjustable rail light mount. However, it differs from the present invention because Rogers, et al. teaches an adjustable and removable rail light mount for attachment to a firearm having a mounting rail that includes a rail mount attached to a rail and a light carrier rotatably attached to the rail mount to position a light to the left or right of a firearm by way of an axle carried by the rail mount. The axle fits through the rail mount and the light carrier. Passageways in the rail mount and the light carrier for the axle include grooves that engage detent bosses on the axle to maintain the light carrier in the selected location. The light carrier is removable when it is rotated to a centered downward position.

Applicant believes that another reference corresponds to U.S. Pat. No. 6,892,488 B1 issued to Serravalle on May 17, 2005 for an illuminating recoil guide rod. However, it differs from the present invention because Serravalle teaches an illuminating recoil guide rod for use on a handgun modified to include a highly illuminating LED or infrared light for a night vision light source, a tilt or mercury switch that will allow for user selectable starting angles of illumination when the firearm is drawn from the holster comprising a lens, battery or batteries, housing compartment, mercury angle switch, electronics, and a manual on/off switch. Drawing the firearm from the holster and raising the barrel activates the illuminating recoil guide rod. It also provides for an additional element in the form of a wireless transmitter and receiver for illuminating the LED only while a pressure sensitive pad is depressed.

Applicant believes that another reference corresponds to U.S. Pat. No. 6,675,521 B1 issued to Kim on Jan. 13, 2004 for an apparatus and method for adjusting orientation offset of a light beam generator. However, it differs from the present invention because Kim teaches an apparatus and method for adjusting the orientation offset of a light source housing of a light beam generator mounted to a firearm, in such manner as to preclude inadvertent rotational displacement of the light source housing. The apparatus includes a coupler secured to the light source housing and adapted for being longitudinally placed for interfacing with and fastenable to the battery housing for incrementally adjusting orientation offset of the light source housing.

Applicant believes that another reference corresponds to U.S. Pat. No. 6,622,416 B2 issued to Kim on Sep. 23, 2003 for target and navigation illuminators for firearms. However, it differs from the present invention because Kim teaches a firearm illuminator for selectively providing low intensity illumination to assist the firearm user to navigate his or her surroundings in dark environments, as well as for selectively providing high intensity illumination of a target. The preferred embodiment includes a vertical handgrip having a battery compartment in the handgrip. A battery retainer cap assembly for the battery compartment includes a battery enable/disable mechanism and a safety latch is provided on the handgrip or battery housing for assuring the retainer cap assembly's secure attachment to the battery housing.

Applicant believes that another reference corresponds to U.S. Pat. No. 4,627,183 B1 issued to Stuckman on Dec. 9, 1986 for a firearm with aiming light. However, it differs from the present invention because Stuckman teaches a firearm having an aiming light secured along the barrel at a position to project a light beam in intersecting relationship with the barrel to cast an aiming shadow from the discharge end portion of the barrel on a lighted target area at the point of impact of the shot pattern of the gun. The aiming light includes a narrow beam focusing lens bulb, a battery, a battery retaining spring and switch member, and an actuating button for operating the spring switch housed in a chamber of the stock of the gun.

Applicant believes that another reference corresponds to Patent Application Publication No. 20100154280 A1, published on Jun. 24, 2010 and U.S. Pat. No. 8,141,290 B1 issued to LaFrance, et al. on Mar. 27, 2012 for a machine gun accessory mount. However, it differs from the present invention because LaFrance, et al. teaches a universal accessory mount for a heavy machine gun that includes an annular base adapted to be disposed concentrically over a front end of a shroud of the gun and having diametrically opposing upper and lower accessory mounting tines extending forwardly therefrom. A holding mechanism pulls a planar floor of a counterbore in the rear of the base into contact with a planar front surface of the shroud of the gun. The holding mechanism includes a pair of threaded bolts extending rearwardly from the base through respective ones of a pair of diametrically opposing bolt apertures contained in the base, and a pair of cleats, each having an opening into which a rear end portion of a respective one of the bolts is received and a respective hook adapted to grip the shroud of the gun through a respective hole in the shroud.

Applicant believes that another reference corresponds to U.S. Pat. Nos. 7,735,255 B1 and 8,132,355 B1 issued to Kincaid, et al. on Jun. 15, 2010 and Mar. 13, 2012, respectively, for offset accessory mount and mounting system. However, they differ from the present invention because Kincaid teaches an adjustable accessory mounting clamp for mounting an accessory to an accessory rail, including an accessory band, a primary locking arm, a secondary locking arm, and a threaded adjustment rod that is anchored, at a first end, to the primary locking arm, extends through an aperture in the secondary locking arm, and is threadedly coupled to a cam lever pin of a cam lever, wherein the cam lever includes at least one camming surface, such that when the cam lever is in a closed position, the camming surface contacts an outer surface portion of the secondary locking arm to provide tension to the threaded adjustment rod, such that a distance between the primary locking claw and the secondary locking claw is adjusted to accommodate varying width accessory mounting rails.

Applicant believes that another reference corresponds to U.S. Pat. No. 7,753,549 B1 issued to Solinsky, et al. on Jul. 13, 2010 for a weapon-aiming device. However, it differs from the present invention because Solinsky, et al. teaches a weapon mountable aiming system that has a multi-laser assembly having a first visible laser pointer assembly, a second infrared laser pointer assembly, and an infrared laser illuminator assembly whose generated light beams extend outwardly through an opening in an actuator used to adjust the divergence of the infrared laser illuminator assembly. The multi-laser assembly being steerable by a set of adjusters in the weapon mountable aiming system to allow alignment of the generated light beams with a point of impact of a bullet with a target.

Applicant believes that another reference corresponds to U.S. Pat. No. 7,726,061 B1 issued to Thummel on Jun. 1, 2010 for a dual beam laser module. However, it differs from the present invention because Thummel teaches a dual beam laser aiming module for a firearm that has a dual-laser alignment housing with a first IR laser assembly in a first cavity and that provides a first beam axis. A second visible laser assembly is adjustably located in a second cavity to provide a second beam having an axis parallel to the first beam axis. A housing for the dual-laser alignment housing is adapted to be fixed to the firearm. The dual-laser alignment housing has a rounded exterior surface that interfaces with a corresponding rounded surface in the interior of the cavity of the laser housing. The dual-laser alignment housing is adjustably pivoted with respect to the laser housing with a four-point laser alignment mechanism to align the parallel first and second axes further in parallel to a centerline of a barrel of the firearm.

Applicant believes that another reference corresponds to U.S. Pat. No. 7,264,369 B1 issued to Howe on Sep. 4, 2007 for a switch configuration for a tactical illuminator. However, it differs from the present invention because Howe teaches a tactical illuminator that has a first switch for providing a lesser amount of visible light on an area of interest than a second switch. The first switch being in close proximity to the second switch to allow an operator to quickly and easily move his finger or thumb from the first switch to the second switch when a need for greater light is encountered. A tactical illuminator has a rotatable switch moveable from a first position that provides a lower level of light output to a second position that provides a greater level of light output. The operator actuating the switch by sliding his finger or thumb parallel to a longitudinal axis of a weapon barrel.

Applicant believes that another reference corresponds to U.S. Pat. No. 6,785,997 B1 issued to Oz on Sep. 7, 2004 for an accessory mount for a firearm. However, it differs from the present invention because Oz teaches an accessory mount, and a method for mounting accessories for a hand held firearm having a barrel and a mounting rail coupled beneath the barrel. The accessory mount includes a frame, defining a substantially flattened bottom surface and a track for mounting along the mounting rail. The frame has a cavity for receiving a light, and a bipod mount coupled adjacent the track and behind the light cavity and arranged to hold a bipod having legs which can be folded substantially adjacent the barrel.

Applicant believes that another reference corresponds to U.S. Pat. No. 6,604,315 B1 issued to Smith, et al. on Aug. 12, 2003 for a method and apparatus for maintaining proper orientation of aiming eye when firing a shotgun. However, it differs from the present invention because Smith, et al. teaches a method and apparatus for assisting a shooter in holding an aiming eye at a predetermined level relative to the barrel of a shotgun. Light is reflected or projected along a path extending at a predetermined rearward, so that the shooter's aiming eye receives a first image when it is at the proper level and a second image when it is above the proper level, thus indicating to the shooter when the aiming eye has been raised too high. The images may be different colors, produced by dispersing the beam by reflecting it from a diffraction grating or passing it through a prism. A lenticular sheet may also be used to create different colors or images that are received above and below the dividing plane. Moire patterns may also be used to produce an image that shifts with movement of the aiming eye. A visual warning may also be provided for indicating when the shooter's aiming eye has moved from proper alignment with the barrel in azimuth or when the non-aiming eye is exerting cross-dominance over the aiming eye.

Applicant believes that another reference corresponds to U.S. Pat. No. 6,591,536 issued to Houde-Walter, et al. on Jul. 15, 2003 for a method and apparatus for side of frame positioning of laser sights and LED illuminators. However, it differs from the present invention because Houde-Walter, et al. teaches a laser-sighting system that can be constructed as a compact side module for use with a revolver or automatic pistol. Features on the side of the firearm such as the yoke screw and the other side plate screws of a revolver are used to secure this laser-sighting system in a favorable location on the side of the firearm frame above the trigger guard forward of the grip, but behind the leading edge of the firearm's trigger guard. The takedown pins or slide stops found in this same location on many automatic pistols can also be used for this purpose. The system uses a self-contained laser-sighting module that does not interfere with the holstering, concealment, or handling of the firearm. The system can also contain a white light or colored LED for illumination and communication.

Applicant believes that another reference corresponds to U.S. Pat. No. 6,473,980 B1 issued to Ripingill, Jr, et al. on Nov. 5, 2002 for an infrared laser transmitter alignment verifier and targeting system. However, it differs from the present invention because Ripingill, Jr, et al. teaches a system for detecting and visually indicating the relative location of an impact on a target of an invisible infrared laser beam emitted from a small arms transmitter (SAT) mounted on a combat rifle. A plurality of red LEDs are mounted on a planar PCB that serves as the target and are arranged along X and Y axes corresponding to azimuth and elevation. A plurality of photo-diodes are mounted on the PCB for generating output signals when struck by the laser beam. The photo-diodes are clustered around the intersection of the X and Y axes. A circuit mounted on a reverse side of the PCB is connected to the plurality of photo-diodes for receiving their output signals. The circuit energizes one or more of the red LEDs to provide a pattern of illumination of the LEDs that represents azimuth and elevation deviation of the laser hit from the intersection of the axes when the SAT is fired with the intersection of the axes in the iron sights of the rifle. The LEDs and photo-diodes are spatially arranged on the PCB to provide an effective magnification of a variation in azimuth and elevation of the location of the impact of the laser beam relative to the intersection of the axes. The circuit also increases the duration of the illumination of the LEDs compared to short duration laser pulses to increase visibility to the soldier. A pair of laser diodes can be mounted on the PCB so that visible red light beams emitted therefrom will crisscross at the appropriate distance and overlap on the soldier's chest. This tells the soldier to fire the SAT-equipped rifle at the target at this location.

Applicant believes that another reference corresponds to U.S. Pat. No. 6,363,648 B1 issued to Kranich, et al. on Apr. 2, 2002 for a laser aiming light for firearms. However, it differs from the present invention because Kranich, et al. teaches a laser aiming light for firearms that includes interchangeable switches for selectively limiting the laser output to an eye safe level for training purposes and for providing full power for operational use in a combat zone. A capability for using a remote switch is provided. As the output of the laser diode and associated components are temperature sensitive, temperature-compensating circuitry ensures adequate power at high, as well as at low, ambient temperatures. Power is provided by enclosed conventional batteries retained by a sealed cap maintained in place by a pivotally mounted retainer and locking mechanism.

Applicant believes that another reference corresponds to U.S. Patent Application Publication No. 20120005938 A1, published on Jan. 12, 2012 to Sloan for a tactical reflectoscope. However, it differs from the present invention because Sloan teaches a three mirror-plane reflectoscope target acquisition accessory, with no moving parts, which mounts to the top, side or under any gun and many other apparatus to allow the user to: view, acquire and/or take action accurately from a cover and hidden position, around a corner, situating their person 90 degree to the side, above or below what is known as a typical firing position to the gun or host to which the tactical reflectoscope is affixed.

Applicant believes that another reference corresponds to U.S. Patent Application Publication No. 20120055061 A1, published on Mar. 8, 2012 to Hartley, et al. for a modular vertical foregrip. However, it differs from the present invention because Hartley, et al. teaches powered modular vertical foregrips that may serve as platforms for multiple firearms accessories, such as modular laser and/or LED lighting and/or sighting systems, radiofrequency receiver and/or transmitter systems, and/or other powered accessories. The embodiments may be adapted to couple to a mounting rail, such as a Picatinny or Weaver rail, and particular embodiments may be adapted to couple to a lower hand guard quad-rail of an M4 or other small arms weapon. Systems in accordance with various embodiments may provide a platform that may consolidate multiple accessory devices and functions into a single ergonomic and compact unit. Thus, in some embodiments, systems disclosed herein may greatly reduce the size and weight of the total accessory package, and may provide an extremely ergonomic platform that is much easier to manage before, during, and after operations.

Applicant believes that another reference corresponds to U.S. Patent Application Publication No. 20110252681 A1, published on Oct. 20, 2011 to Houde-Walter, et al. for a pulse modulated laser sight for firearms. However, it differs from the present invention because Houde-Walter teaches a laser-sighting device for a semi-automatic handgun having a recoil spring guide chamber housing a recoil spring surrounding a spring guide. The laser sighting device includes a pulse modulated laser received within the spring guide, having an input and a light output for emitting a pulse modulated laser light aligned with a path of a bullet fired by the handgun; and a sensor for detecting firing of the handgun, having an output coupled to the input of the pulse modulated laser. When the sensor detects the handgun has been fired, the output of the sensor triggers the pulse-modulated laser to emit a train of pulses of laser light.

Applicant believes that another reference corresponds to U.S. Patent Application Publication No. 20110232151 A1, published on Sep. 29, 2011 to Zukowski for an integral, frame-mounted laser aiming device. However, it differs from the present invention because Zukowski teaches a light emitting apparatus that is installed in an inner recess defined by a lower muzzle portion of a frame of a firearm. The light emitting apparatus is accessible through pass-through holes or openings formed in the lower muzzle portion of the frame. The light emitting apparatus includes a laser-aiming device that emits light through a first opening defined below a barrel of the firearm; activation switches accessible through second openings defined in each side of the frame. The laser-aiming device is retained in the inner recess by a hold down screw inserted through a bore therein and into a threaded insert disposed in the bottom surface of the inner recess.

Applicant believes that another reference corresponds to U.S. Patent Application Publication No. 20110167707 A1, published on Jul. 14, 2011 to Gross, et al. for a tactical illuminator. However, it differs from the present invention because Gross, et al. teaches a tactical illuminator having an integrated illuminator system including a horizontally-oriented foregrip, a power source, a rotary switch, a toggle switch, a depressible switch, an attachment mechanism, navigation lights, an aiming laser, and a main illuminator.

Applicant believes that another reference corresponds to U.S. Patent Application Publication No. 20090178325 A1, published on Jul. 16, 2009 to Veilleux for a handgrip system with integrated sight for mounting to firearm. However, it differs from the present invention because Veilleux teaches a semi-automatic or automatic rifle that includes a receiver having a receiver frame, a barrel connected to the receiver frame, a hand guard section extending over and generally surrounding the barrel, the hand guard section connected to the receiver, an accessory mount connected to the receiver frame and located below the barrel, a hand grip with an integrated sight removably connected to the accessory mount, the removable hand grip having a locating and locking feature adapted to engage the accessory mount, wherein, the removable hand grip is selectably interchangeable with other hand grips, each having different predetermined characteristics selectable for coupling to the rifle and wherein, the removable hand grip is configured so that it forms a stand alone sighting device independent of the rifle.

Applicant believes that another reference corresponds to U.S. Patent Application Publication No. 20080060248 A1, published on Mar. 13, 2008 to Pine for a stealth laser sighting system for firearms. However, it differs from the present invention because Pine teaches a stealth laser sighting system for a firearm that includes a non-visible laser and night imaging device with display. The stealth laser sighting system combines all of the features required for stealth laser sighting within a self-contained accessory. The stealth laser sighting system provides for an optional visible laser system and can include features such as electronic calibration, laser rangefinder compensation, target zoom, projected graphic laser marking, and windage and elevation adjustments on a graphical overlay. The stealth laser sighting system can be packaged as an accessory or all of the features can be integrated into a firearm.

Applicant believes that another reference corresponds to U.S. Patent Application Publication No. 20080039962 A1, published on Feb. 14, 2008 to McRae for a firearm system for data acquisition and control. However, it differs from the present invention because McRae teaches a microprocessor circuit that is used to monitor and control a firearm. The microprocessor circuit accomplishes this by monitoring various sensor & control inputs, and acting on these inputs to execute user defined functions. The microprocessor circuit can use the sensory input to determine firearm statistics. These statistics can include the number of times the firearm has been shot, the efficiency of the firearm automatic action, range-to-target, and et cetera. The firearm system can also use a combination of sensors to fabricate a bullet chronograph whereby the muzzle velocity of a cartridge can be determined. These statistics can be date-stamped and recorded into memory. Statistics from Law Enforcement firearms can be used for courtroom evidence and police reporting. These statistics can also be used for firearm maintenance and warranty repair. The microprocessor circuit can display the statistical data to the user via simple light emitting diodes, or sophisticated liquid crystal displays. Data can also be downloaded to a computer docking station as well. The microprocessor circuit can also display the information within the optics of a riflescope. When used in conjunction with a laser range finder sensor, the microprocessor circuit can adjust the electronic crosshairs (reticle) to compensate for the bullet trajectory.

Applicant believes that another reference corresponds to U.S. Patent Application Publication No. 20070227056 A1, published on Oct. 4, 2007 to Howe, et al. for a tactical illuminator. However, it differs from the present invention because Howe, et al. teaches a plurality of actuators that allow a gun operator to control the on/off status of an illuminator attached to a weapon in the area forward of the trigger guard. The actuators are spaced to allow them to extend rearwardly on opposite sides of the trigger guard. "Up" turns the light emitter on and keeps it on or allows it to turn on as long as the actuator is actuated, regardless of which side of the trigger guard the actuators is actuated.

Applicant believes that another reference corresponds to U.S. Patent Application Publication No. 20070009860 A1, published on Jan. 11, 2007 to Young for a boresight device and method. However, it differs from the present invention because Young teaches a modular system that facilitates alignment of a simulation laser with the sights of a weapon. The modular assembly can be attached to the barrel of a weapon. A user can first align a target relative to the sights of the weapon. The laser can then be aligned with the target.

Other patents describing the closest subject matter provide for a number of more or less complicated features that fail to solve the problem in an efficient and economical way. None of these patents suggest the novel features of the present invention.

SUMMARY OF THE INVENTION

The present invention is a weapon mountable illumination and aiming system, defined as a tactical illuminating system for weapons. It comprises multiple light emitting diode emitters on a weapon platform, arranged such that one or more white emitter and/or infrared or other specialized emitters are on both sides of the weapon, defined by but not limited to, left and right of a centerline; and a dual white/red and/or infrared emitter located on/or near the centerline below the weapon's barrel with a laser. The emitters will be separate from a power source, and they will be fairly small. A joystick controller using deflection movement of stick or pressure of deflection controls all the emitters and laser.

More specifically, the present invention is a tactical illuminating system for weapons, comprising a grip body comprising a joystick button. The grip body further comprises at least first and second illumination sources and at least one laser emitter. The grip body mounts onto a rail member of a quail rail hand guard. At least first and second side illuminator housings comprise third and fourth illumination sources respectively. The at least first and second side illuminator housings mount onto the quail rail hand guard. The present invention further comprises an electrical system.

The at least first and second illumination sources are positioned on both sides of a weapon, and the at least third and fourth illumination sources are also positioned on both sides of the weapon. The at least first and second illumination sources and the at least third and fourth illumination sources are independently controlled by the joystick button. The at least first and second illumination sources and the at least third and fourth illumination sources provide light sources on strong and/or advantageous sides of the weapon when cornering without having to change grip, sight picture, an angle of the weapon, or stance. The at least first and second illumination sources and the at least third and fourth illumination sources prevent barrier flash back of light from blinding or affecting an operator's night vision, while preventing unintended illumination and silhouetting of the operator to a target.

The grip body further comprises a joystick housing to partially house the joystick button. The joystick button permits instant and ambidextrous control of the at least first and second illumination sources, the at least one laser emitter, and the at least third and fourth illumination sources while also controlling intensity of light by use of progressive deflection or pressure on the joystick button. The at least first and second illumination sources, and the at least third and fourth illumination sources are light emitting diodes. The grip body further comprises a forward end, an aft end, first and second sidewalls, and a base. The forward end, the aft end, and the first and second sidewalls define a grip section. The grip section comprises at least one protrusion. The first sidewall comprises a cover plate for access to the electrical system. The grip body further comprises a battery compartment for access to a power source. The grip body further comprises a top wall having first and second longitudinal edges connected to each other by a transversal edge. The first and second longitudinal edges are parallel with respect to each other, and with the transversal edge, define a base wall and an elongated cavity to receive the rail member of the quail rail hand guard. The grip body further comprises a bottom illuminator housing having first and second holes for the at least first and second illumination sources. The bottom illuminator housing further comprises a bottom illuminator housing having a third hole for the at least one laser emitter. The at least first and second side illuminator housings comprise first and second holes for the third and fourth illumination sources respectively. The electrical system comprises at least one integrated circuit, at least one joystick controller, and at least one dipswitch board. The at least first and second illumination sources, and the at least third and fourth illumination sources comprise respective optics for the light emitting diodes.

It is therefore one of the main objects of the present invention to provide tactical illuminating systems for weapons that are mountable aiming systems.

It is another object of this invention to provide tactical illuminating systems for weapons comprising light emitting diode emitters on a weapon, such that one or more, or combination of white and infrared or other specialized emitters is on either side of the weapon, and a dual white/red and infrared or other specialized emitter is positioned below the white emitters with a laser.

It is another object of this invention to provide tactical illuminating systems for weapons, whereby the emitters will be separate from a power source.

It is another object of this invention to provide tactical illuminating systems for weapons comprising a joystick controller to control all emitters.

It is another object of this invention to provide tactical illuminating systems for weapons to enable complete light control including brightness.

It is another object of this invention to provide tactical illuminating systems for weapons to enable side origination for cornering modes in an effort to not illuminate or flash on barriers.

It is another object of this invention to provide tactical illuminating systems for weapons to enable placement and individual use of specific lights in an array around a barrel of a weapon to produce a unique effect.

It is another object of this invention to provide tactical illuminating systems for weapons that mount onto a quad rail hand guard of a rifle, shotgun, handgun, or any other similar lethal or non-lethal platform, including a crossbow.

It is another object of this invention to provide a tactical illuminating system for weapons, which is of a durable and reliable construction.

It is yet another object of this invention to provide a tactical illuminating system for weapons that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
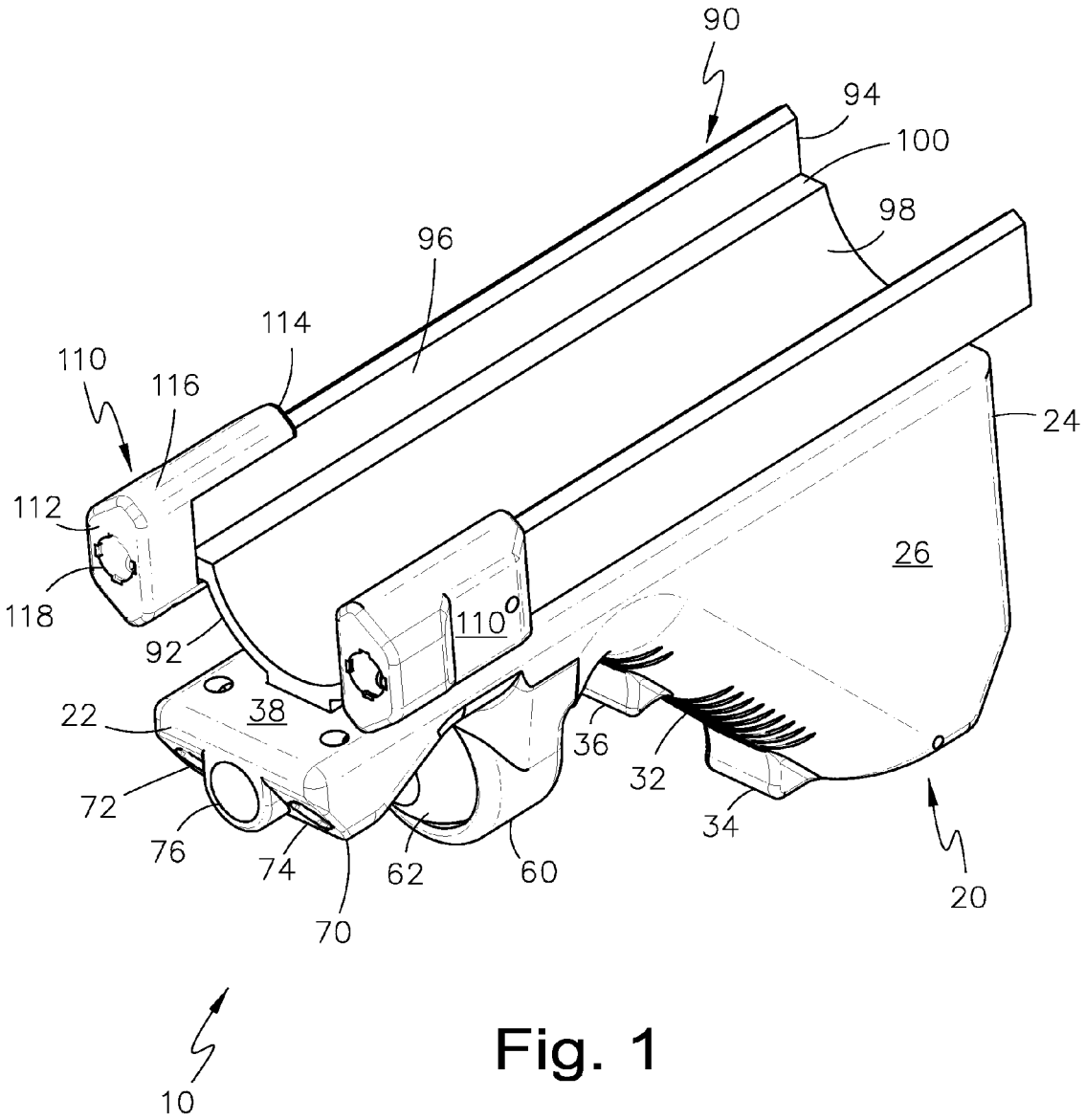
FIG. 1 is a front isometric view of the present invention mounted onto a bottom section of a quad rail hand guard.

Referring now to the drawings, the present invention is generally referred to with numeral 10. It can be observed that it basically includes grip body 20, side illuminator housings 110, and electrical system 140.

Figure 2:
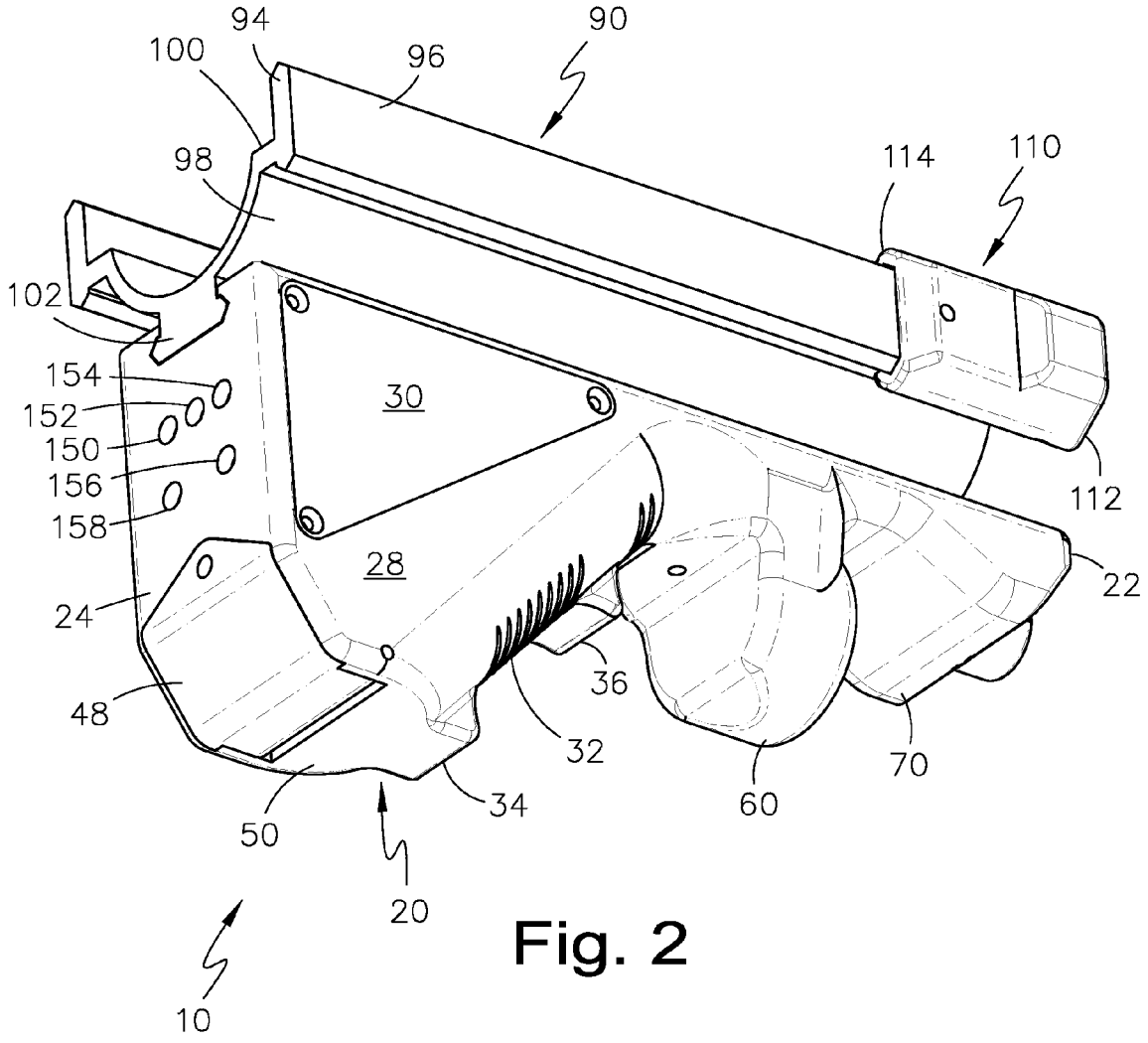
FIG. 2 is a rear isometric view of the present invention mounted onto the bottom section of the quad rail hand guard.

As seen in FIGS. 1 and 2, present invention 10 is a weapon mountable illumination and aiming system, defined as a tactical illuminating system for weapons having quad rail hand guard 90. It is noted that only a bottom section of quad rail hand guard 90 is illustrated to demonstrate how instant invention 10 is mounted thereon. Quad rail hand guard 90 comprises forward end 92, aft end 94, sidewalls 96, channel section 98, intermediate ledges 100, and rail member 102. Grip body 20 and side illuminator housings 110 are cooperatively shaped to mount onto quad rail hand guard 90. Grip body 20 comprises forward end 22, aft end 24, and sidewalls 26 and 28. Grip body 20 further comprises grip section 32 having protrusions 34 and 36. Grip section 32 and protrusions 34 and 36 enable a user to ergonomically grip and/or handle and control instant invention 10 mounted onto quad rail hand guard 90 of weapon 200, seen in FIG. 5. Grip section 32 and protrusions 34 and 36 may comprise hatchings and/or surface markings for optimal grip and/or handle and control.

Each side illuminator housing 110 comprises forward end 112, aft end 114, exterior wall 116, and hole 118.

As best seen in FIG. 2, grip body 20 further comprises battery compartment door 48 and base 50. Furthermore, at aft end 24 are buttons 150, 152, and 154; and battery power indicator light 156 and master on/off light 158. Sidewall 28 has cover plate 30 secured thereon. Cover plate 30 serves as an access to electrical system 140, seen in FIGS. 3 and 4.

Figure 3:
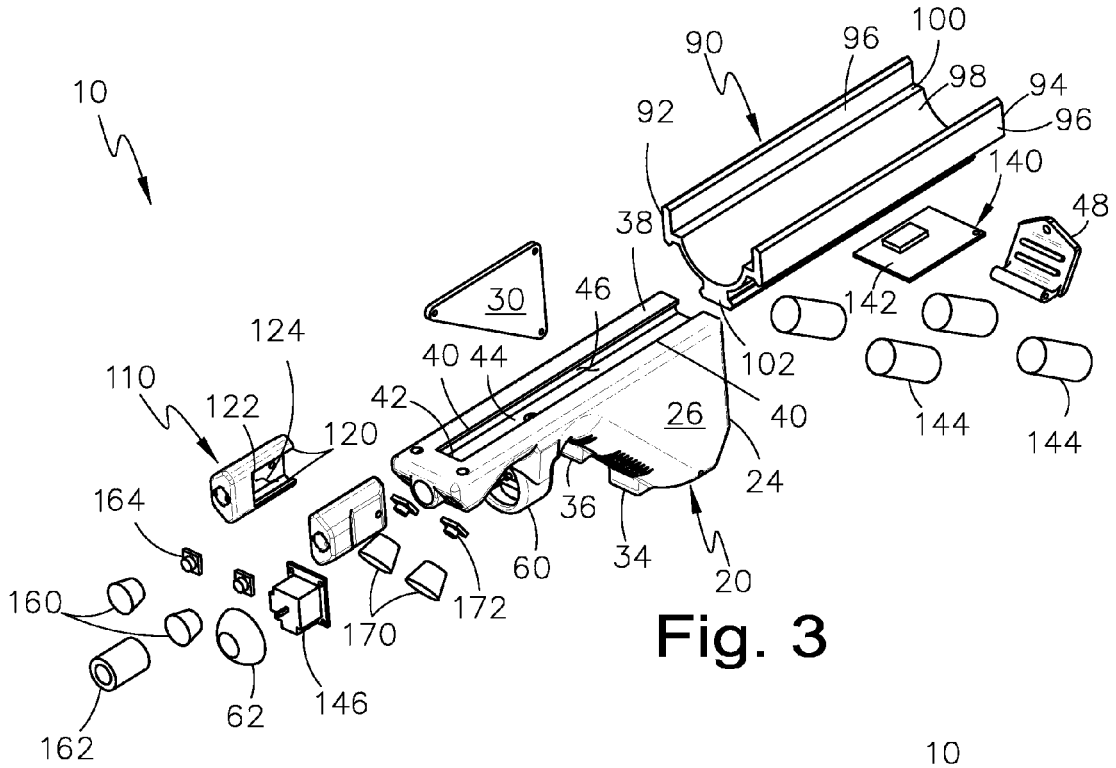
FIG. 3 is a first exploded view of the present invention and the bottom section of the quad rail hand guard.
Figure 4:
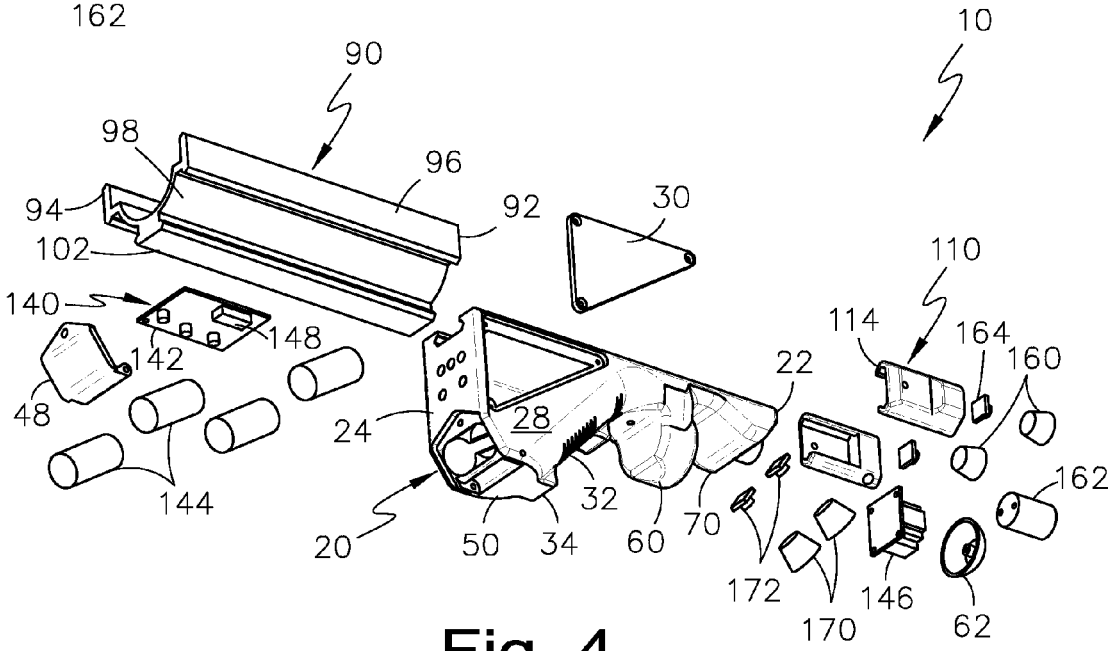
FIG. 4 is a second exploded view of the present invention and the bottom section of the quad rail hand guard.

As best seen in FIGS. 3 and 4, grip body 20 further comprises base wall 44, and top wall 38 having longitudinal edges 40 and transversal edge 42, to define elongated cavity 46 shaped to receive rail member 102 of quad rail hand guard 90.

Side illuminator housings 110 each further comprise longitudinal edges 120 and transversal edge 122, to define elongated cavity 124 shaped to receive forward ends 92 of quad rail hand guard 90.

Electrical system 140 comprises integrated circuit 142 connected to all components thereof. Integrated circuit 142, also referred to as a monolithic integrated circuit, IC, chip, or microchip, is an electronic circuit manufactured by lithography, or a patterned diffusion of trace elements into a surface of a thin substrate of semiconductor material. Additional materials are deposited and patterned to form interconnections between semiconductor devices. Electrical system 140 further comprises power source 144, which in preferred embodiment is at least one battery, and joystick controller 146.

Electrical system 140 further comprises at least light-emitting diode (LED) emitters 164 having LED optics 160. Holes 118 are for LED emitters 164. In a preferred embodiment, LED emitters 164 are illumination sources and emit white light. LED emitters 164 may also emit infrared light, or be another type of specialized emitter.

Below LED emitters 164 are at least LED emitters 172 having LED optics 170. In a preferred embodiment, LED emitters 172 are illumination sources and emit dual white/red lights. LED emitters 172 may also emit infrared light, or be another type of specialized emitter.

Above LED emitters 172 is at least one laser emitter 162 that emits a red laser red.

Grip body 20 further comprises bottom illuminator housing 70 having holes 72, 74, and 76, best seen in FIG. 1. Holes 72 and 74 accommodate LED emitters 172 having LED optics 170, and hole 76 accommodates laser emitter 162.

Grip body 20 further comprises joystick housing 60. Joystick housing 60 houses joystick controller 146 and has joystick button 62 thereon. Utilizing joystick button 62, a user can control joystick controller 146. In a preferred embodiment, the following functionalities are performed:

a) increasing pressure or deflection of joystick button 62 changes the intensity of light emitting from LED emitters 164 and 172, and turns laser emitter 162 "on";
b) biasing joystick button 62 downwardly turns LED emitters 172 "on" to a search mode, matching intensity to the deflection or pressure of the joystick 62;
c) biasing joystick button 62 leftwardly turns a respective left of LED emitters 164 "on", matching intensity to the deflection or pressure of the joystick 62, and laser emitter 162 "on" if light mode is selected;
d) biasing joystick button 62 rightwardly turns a respective right of LED emitters 164 "on", matching intensity to the deflection or pressure of the joystick 62, and laser emitter 162 "on" if light mode is selected; and
e) biasing joystick button 62 upwardly turns all LED emitters 164 and LED emitters 172 "on", matching intensity to the deflection or pressure of the joystick 62, and laser emitter 162 "on" to an attack light mode.

As stated above, electrical system 140 comprises buttons 150, 152, and 154; battery power indicator light 156, and master on/off light 158.

In a preferred embodiment, the following functionalities are performed:

f) button 150 is a strobe on/off: —when depressed in it activates a strobe feature on LED emitters 164 and 172, and laser emitter 162 in all modes except "stealth" and "stun";
g) button 152 is a daytime designator laser emitter 162 on/off for Momentary Laser Mode: —when depressed in, only allows laser emitter 162 to come "on" in any momentary mode (overrides lights); and
h) button 154 is a light hold "on" mode: —once joystick button 62 has been biased to a desired light or group of lights, pressing joystick button 62 inwardly causes them to remain "on", and pressing again, "off".

As best seen in FIG. 3, dip switch board 148 is located on a bottom side of integrated circuit 142. Dip switch board 148 permits the following functionalities:

i) Strobe Speed—activated with button 150, dip switch board 148 controls a speed of flashes when a strobe cycle is activated. In a preferred embodiment, the speed of flashes include first, second, and third predetermined speeds, each faster then the prior.

j) Momentary Laser Mode—dip switch board 148 controls power to laser emitter 162 in relation to all light modes except a "stealth" mode (red light).

k) Stun Mode—dip switch board 148 controls the Stun Mode causing all white light to emit from LED emitters 164 and 172 for a brief flash by pushing joystick button 62 inwardly to "on". The Stun Mode is overridden with buttons 150 and 154 when activated.

l) Reverse Cornering Control—dip switch board 148 further enables selecting a desired side (left or right) from which lights emits from LED emitters 164 for strategic cornering.

Figure 5:
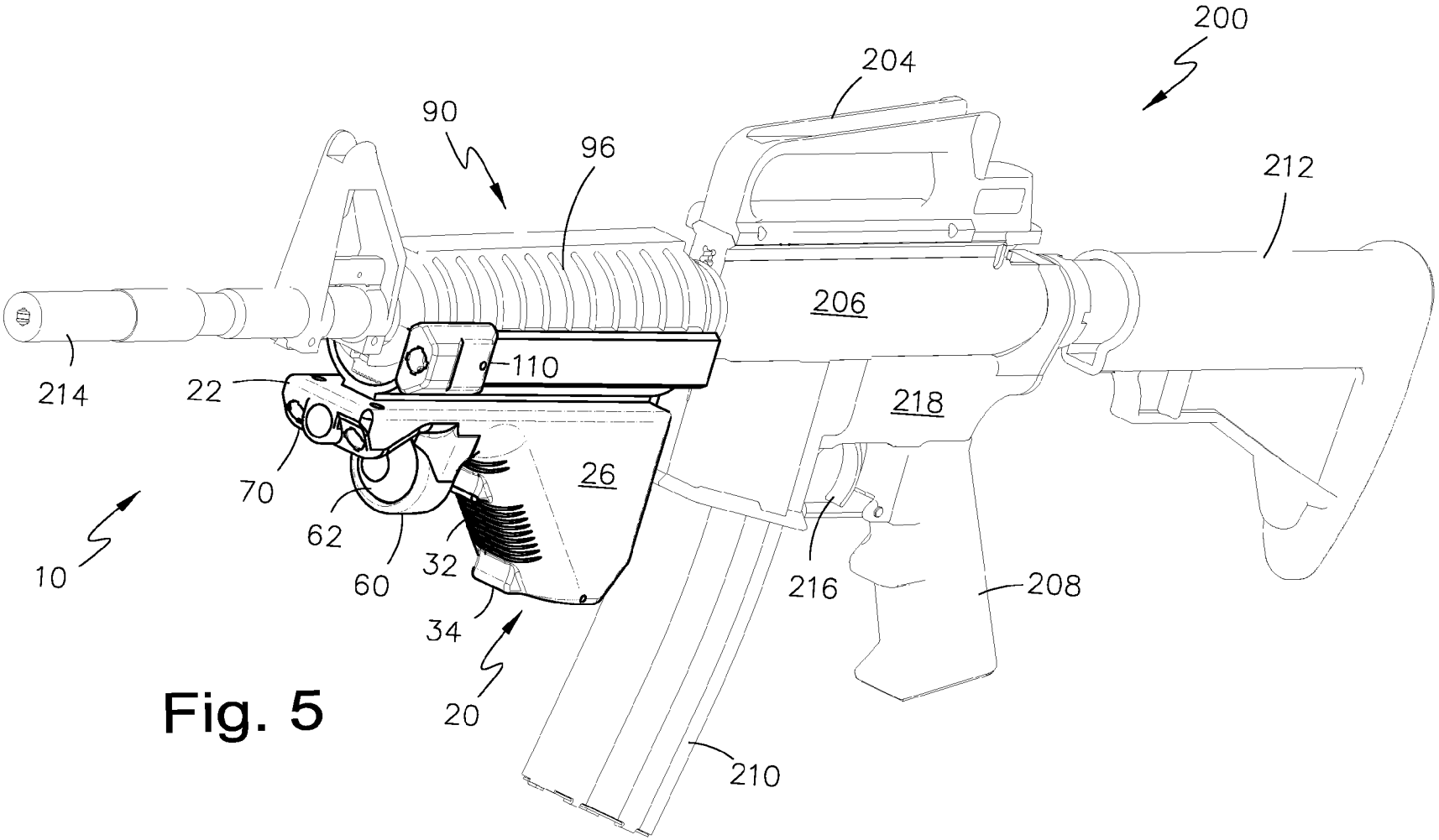
FIG. 5 is an isometric view of the present invention mounted onto a weapon.

As seen in FIG. 5, in a preferred embodiment, instant invention 10 mounts onto quad rail hand guard 90 of weapon 200. In a preferred embodiment, weapon 200 is an assembled rifle further comprising handle 204, upper receiver 206, grip handle 208, magazine 210, buttstock 212, barrel 214, trigger 216, and lower receiver 218.

However, instant invention 10 may also be integrated or mounted onto any weapon 200 comprising at least a section of a rail member 102 and at least a section of sidewalls 96 on a hand guard 90. Weapon 200 may also be a firearm such as a shotgun or handgun, rifle, semi-automatic rifle, shoulder-fired weapon, or any other similar lethal or non-lethal platform, including a crossbow. Furthermore, instant invention 10 may also be integrated or mounted onto any free floating hand guard 90, or a lower half of a two-piece "AR-15", "M-16", "M-4" style platform, or adapted to any other lethal or non-lethal platform that has a replaceable front hand guard 90.

Present invention 10 therefore enables side origination for cornering modes in an effort to not illuminate or flash on barriers. Furthermore, present invention 10 enables placement and individual use of LED emitters 164 and 172, and laser emitter 162 in an array around barrel 214 of weapon 200 to produce a unique effect.

As best seen in FIG. 5, LED emitters 164 and 172 are positioned purposely of both sides of weapon 200 and independently controlled by joystick button 62 to provide light sources on strong and/or advantageous sides of weapon 200 when cornering, without having to change grip, sight picture, weapon 200 angle, or stance. The position of LED emitters 164 and 172 also prevent barrier flash back of light from blinding or affecting an operator's night vision, while at the same time preventing unintended illumination and silhouetting of the operator to the target.

Joystick button 62 permits the ability to instantly and ambidextrously control individual or multiple illumination of LED emitters 164 and 172, and laser emitter 162, while also controlling intensity of light by use of progressive deflection or pressure on joystick button 62. Joystick button 62 also permits a 0%-100% control of light intensity deflection or pressure upon joystick button 62.

Button 150 is a strobe on/off, permitting the programming of a laser strobing feature to allow for specific weapon targeting designation for weapons launched from various aircraft and crew served sources that use a coded laser designation for targeting. Dip switch board 148 controls a speed of flashes when a strobe cycle is activated. Therefore, permitting the programming of speed of flashes and to change frequency of the laser strobing or to program the laser strobing in disorienting strobe patterns.

Battery power indicator light 156 is activated for a predetermined time period, typically a short period, upon start up and manually activated by the operator to indicate a full charge, operating on $2^{nd}$ set of batteries from power source 144, and a low charge, as an example 50% power.

Instant invention 10 is of a streamlined design to reduce and eliminate if possible protrusions for comfort and protection from injury while attached to the operator by a sling device or lanyard, and during the process of transitioning from carry mode to sling mode during a primary to secondary weapon exchange. In addition, instant invention 10 is of a streamlined design to reduce and eliminate if possible any chance of catching on an obstacle or gear, defined as a snag hazard, or being torn off or rendered inoperable by contacting obstacle. Furthermore, instant invention 10 is of a streamlined design to reduce and eliminate if possible instant invention 10 from becoming dislodged or dismounted from weapon 200.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A tactical illuminating system for weapons, comprising:

A) a grip body comprising a joystick button, said grip body further comprising at least first and second illumination sources and at least one laser emitter, said grip body mounts onto a rail member of a quail rail hand guard;

B) at least first and second side illuminator housings comprising third and fourth illumination sources respectively, said at least first and second side illuminator housings mount onto said quail rail hand guard, said third and fourth illumination sources are positioned above said at least one laser emitter, and are independently controlled by said joystick button to isolate each said third and fourth illumination sources, wherein reflective light is minimized in a strong side configuration; and C) an electrical system.

2. The tactical illuminating system for weapons set forth in claim 1, further characterized in that said at least first and second illumination sources are positioned on both sides of a weapon respectively.

3. The tactical illuminating system for weapons set forth in claim 1, further characterized in that said at least third and fourth illumination sources are positioned on both sides of a weapon respectively.

4. The tactical illuminating system for weapons set forth in claim 1, further characterized in that said at least first and second illumination sources are independently controlled by said joystick button.

5. The tactical illuminating system for weapons set forth in claim 1, further characterized in that said at least first and second illumination sources and said at least third and fourth illumination sources provide light sources on strong and/or advantageous sides of a weapon when cornering.

6. The tactical illuminating system for weapons set forth in claim 1, further characterized in that said at least first and second illumination sources and said at least third and fourth illumination sources provide light sources on strong and/or advantageous sides of a weapon when cornering without having to change grip, sight picture, an angle of said weapon, or stance.

7. The tactical illuminating system for weapons set forth in claim 1, further characterized in that said at least first and second illumination sources and said at least third and fourth illumination sources prevent barrier flash back of light from blinding or affecting an operator's night vision, while preventing unintended illumination and silhouetting of said operator to a target.

8. The tactical illuminating system for weapons set forth in claim 1, further characterized in that said grip body further comprises a joystick housing to partially house said joystick button, said joystick button permits instant and ambidextrous control of said at least first and second illumination sources, said at least one laser emitter, and said at least third and fourth illumination sources while also controlling intensity of light by use of progressive deflection or pressure on said joystick button.

9. The tactical illuminating system for weapons set forth in claim 1, further characterized in that said at least first and second illumination sources, and said at least third and fourth illumination sources are light emitting diodes.

10. The tactical illuminating system for weapons set forth in claim 1, further characterized in that said grip body further comprises a forward end, an aft end, first and second sidewalls, and a base.

11. The tactical illuminating system for weapons set forth in claim 10, further characterized in that said forward end, said an aft end, and said first and second sidewalls define a grip section.

12. The tactical illuminating system for weapons set forth in claim 11, further characterized in that said grip section comprises at least one protrusion.

13. The tactical illuminating system for weapons set forth in claim 10, further characterized in that said first sidewall comprises a cover plate for access to said electrical system.

14. The tactical illuminating system for weapons set forth in claim 10, further characterized in that said grip body further comprises a battery compartment for access to a power source.

15. The tactical illuminating system for weapons set forth in claim 1, further characterized in that said grip body further comprises a top wall having first and second longitudinal edges connected to each other by a transversal edge, said first and second longitudinal edges are parallel with respect to each other, and with said transversal edge, define a base wall and an elongated cavity to receive said rail member of said quail rail hand guard.

16. The tactical illuminating system for weapons set forth in claim 1, further characterized in that said grip body further comprises a bottom illuminator housing having first and second holes for said at least first and second illumination sources.

17. The tactical illuminating system for weapons set forth in claim 16, further characterized in that said bottom illuminator housing further comprises a bottom illuminator housing having a third hole for said at least one laser emitter.

18. The tactical illuminating system for weapons set forth in claim 1, further characterized in that said at least first and second side illuminator housings comprise first and second holes for said third and fourth illumination sources respectively.

19. The tactical illuminating system for weapons set forth in claim 1, further characterized in that said electrical system comprises at least one integrated circuit, at least one joystick controller, and at least one dipswitch board.

20. The tactical illuminating system for weapons set forth in claim 9, further characterized in that said at least first and second illumination sources, and said at least third and fourth illumination sources comprise respective optics for said light emitting diodes.

* * * * *